United States Patent [19]

Schmid

[11] 4,233,001

[45] Nov. 11, 1980

[54] PERISTALTIC PUMP

[75] Inventor: Carl J. Schmid, Port Washington, N.Y.

[73] Assignee: Peerless Electronics Research Corporation, Westbury, N.Y.

[21] Appl. No.: 16,161

[22] Filed: Feb. 28, 1979

[51] Int. Cl.[3] ..... F04B 43/12; F04B 45/08

[52] U.S. Cl. ..... 417/475; 417/477; 422/82

[58] Field of Search ..... 47/475, 477; 422/82

[56] References Cited

U.S. PATENT DOCUMENTS

| | | | |
|---|---|---|---|
| 2,797,149 | 6/1957 | Skeggs | 422/82 |
| 2,865,303 | 12/1958 | Ferrari et al. | 417/475 |
| 2,893,324 | 7/1959 | Isreeli et al. | 417/425 |
| 2,935,028 | 5/1960 | Ferrari et al. | 417/475 |
| 3,101,674 | 8/1963 | Weiskopf et al. | 417/475 |
| 3,167,397 | 1/1965 | Skeggs | 417/477 X |
| 3,306,229 | 2/1967 | Smythe | 417/475 |
| 3,588,281 | 6/1971 | Isreeli | 417/475 |
| 4,049,381 | 9/1977 | Burns | 422/82 |

*Primary Examiner*—Richard E. Gluck
*Attorney, Agent, or Firm*—Lee C. Robinson, Jr.

[57] ABSTRACT

A peristaltic pump having an array of compressible tubes in parallel substantially coplanar relationship with each other. A cylindrical rotor assembly including a series of equally spaced rollers around its periphery is located adjacent one side of the array of tubes, and a resiliently mounted platen assembly is located adjacent the other side of the array in position to urge the tubes into contact with the rollers. The platen assembly is provided with a first arcuate ledge portion which defines a first pair of spaced occlusion points and a second arcuate ledge portion which defines a second pair of spaced occlusion points. An additional compressible tube containing air or other segmentizing fluid extends between the rotor and the first ledge portion, it is then directed back in the opposite direction between the rotor and the second ledge portion, and it then proceeds externally with respect to the rotor and platen assembly with the downstream end of the additional tube connected to a junction point in open communication with one of the tubes in the array. As the rotor assembly rotates, it progressively occludes each of the tubes in the array as well as the additional tube over the entire distance between the first pair of spaced points, to pump the first fluid and the segmentizing fluid through their respective tubes, and it also periodically occludes the additional tube between the second pair of spaced points, to periodically introduce the segmentizing fluid to the junction point in timed relation to the flow of the first fluid. The segmentizing fluid is introduced during the intervals when there is a continuous flow of the first fluid past the junction point.

13 Claims, 9 Drawing Figures

PERISTALTIC PUMP

BACKGROUND OF THE INVENTION

This invention relates to pumping apparatus and more particularly to peristaltic pumps in which fluid is directed through a compressible tube by progressively occluding the tube between preselected points along its length.

The present invention, while of general application, is particularly well suited for use in simultaneously pumping a series of fluids in predetermined relative proportions at predetermined flow rates. As is well known, pumps employed for this purpose include an array of resiliently compressible tubes which are arranged in parallel substantially coplanar relationship with each other adjacent a continuously rotating rotor assembly. The rotor assembly is provided with a plurality of rollers for simultaneously occluding the tubes between spaced points along each tube. The tubes customarily have different internal diameters to vary the volume of fluid between the occlusion points and thereby pump different quantities of fluid. For analytical purposes certain of the tubes may contain a liquid sample which is mixed with one or more reagents in other tubes to provide a particular color, the optical density of which is indicative of the concentration of a substance in the sample. The sample fluid, either before or after the addition of the reagent, is separated into sequential segments by the introduction of air or other segmentizing fluid at equally spaced intervals.

Heretofore, pumping apparatus of the foregoing type exhibited certain disadvantages. For example, in many prior peristaltic pumps difficulties were encountered in introducing the segmentizing fluid in a manner that would provide an abrupt separation between successive fluid segments. As another illustration, and this was of special moment for pumping apparatus of the type in which chain driven rollers were used to sequentially occlude and then release a series of compressible tubes, the tubes exhibited excessive wear and were subject to other malfunctions. A still further difficulty exhibited by such prior pumping apparatus was occasioned by deficiencies in the supporting structure for the rotor assembly which resulted in excess friction and wear of the individual rollers.

SUMMARY

One general object of this invention, therefore, is to provide new and improved pumping apparatus of the type in which fluid is directed through a compressible tube by progressively occluding the tube between preselected points along its length.

More specifically, it is an object of the invention to provide such pumping apparatus in which air or other segmentizing fluid is periodically introduced into the tube to provide a clean and well defined separation between successive fluid segments.

Another object of the invention is to provide pumping apparatus of the character indicated in which the wear resulting from the repeated occlusion of the tube is substantially reduced.

A further object of the invention is to provide a rotary peristaltic pump having an improved supporting structure for the rotor assembly of the pump.

A still further object of the invention is to provide pumping apparatus utilizing comparatively simple mechanical components which are economical to manufacture and thoroughly reliable in operation.

In an illustrative embodiment of the invention, the pumping apparatus includes an array of compressible tubes in parallel substantially coplanar relationship with each other. A cylindrical rotor assembly is located adjacent one side of the array of tubes, and a resiliently mounted platen is located adjacent the other side of the array. The rotor assembly has a series of equally spaced rollers around its periphery in position to sequentially engage the tubes and urge each tube simultaneously against the platen. The rotor is driven at a constant speed to progressively occlude the tubes over the entire distance between a pair of spaced points along the length of each tube and thereby pump fluid through the tubes in a given direction.

In accordance with one feature of the invention, the apparatus is provided with an additional compressible tube of unique configuration and arrangement. This latter tube is used to insert a segmentizing or other fluid different from the first fluid into one of the tubes in the array, and it preferably is in open communication with the one tube at a junction point on the downstream side of the pump. The additional tube extends between the rotor assembly and the platen in the same direction as the array of tubes, it then proceeds back in the opposite direction and again passes between the rotor assembly and the platen, and it is then led externally with respect to the rotor assembly and platen to the junction point. As the rotor assembly rotates, it occludes the additional tube in a manner similar to that of the array of tubes, and it also subjects the additional tube to a second occlusion to periodically admit the segmentizing fluid in timed relation to the flow of the first fluid, past the junction point. The second occlusion of the additional tube, occuring as it does in the reverse direction, creates a suction effect which provides a very clean break in the introduction of the additional fluid and hence a clear and abrupt separation between successive segments of the first fluid.

In accordance with another feature of the invention, in certain particularly advantageous embodiments, the platen includes a pair of arcuate ledge portions in facing relationship with the various tubes. The first defines the location of a first pair of spaced points along the length of each tube, while the second ledge portion defines the location of a second pair of spaced points along the length of only the additional tube. As the rotor assembly rotates, the rollers progressively occlude all of the tubes over the entire distance between the first pair of points, to pump the primary and segmentizing fluids therethrough in a downstream direction, and they also progressively occlude the additional tube between the second pair of spaced points, to periodically admit the segmentizing fluid in timed relation to the flow of the primary fluid. With this arrangement, there is no necessity for separate pumping apparatus, valving arrangements, etc., for controlling the flow of the segmentizing fluid.

In accordance with a further feature of several embodiments of the invention, the rotor assembly is supported between a pair of stationary side plates which are maintained in spaced relationship with the individual rollers at all times. The arrangement is such that the supporting structure is separate from the rotor assembly itself and does not come into contact with the individual rollers. As a result, the incidence of unnecessary wear on the rollers is maintained at a minimum.

The present invention, as well as further objects and features thereof, will be more fully understood from the following description of a preferred embodiment, when read with reference to the accompanying drawings.

DESCRIPTION OF A PREFERRED EMBODIMENT

Figure 1:
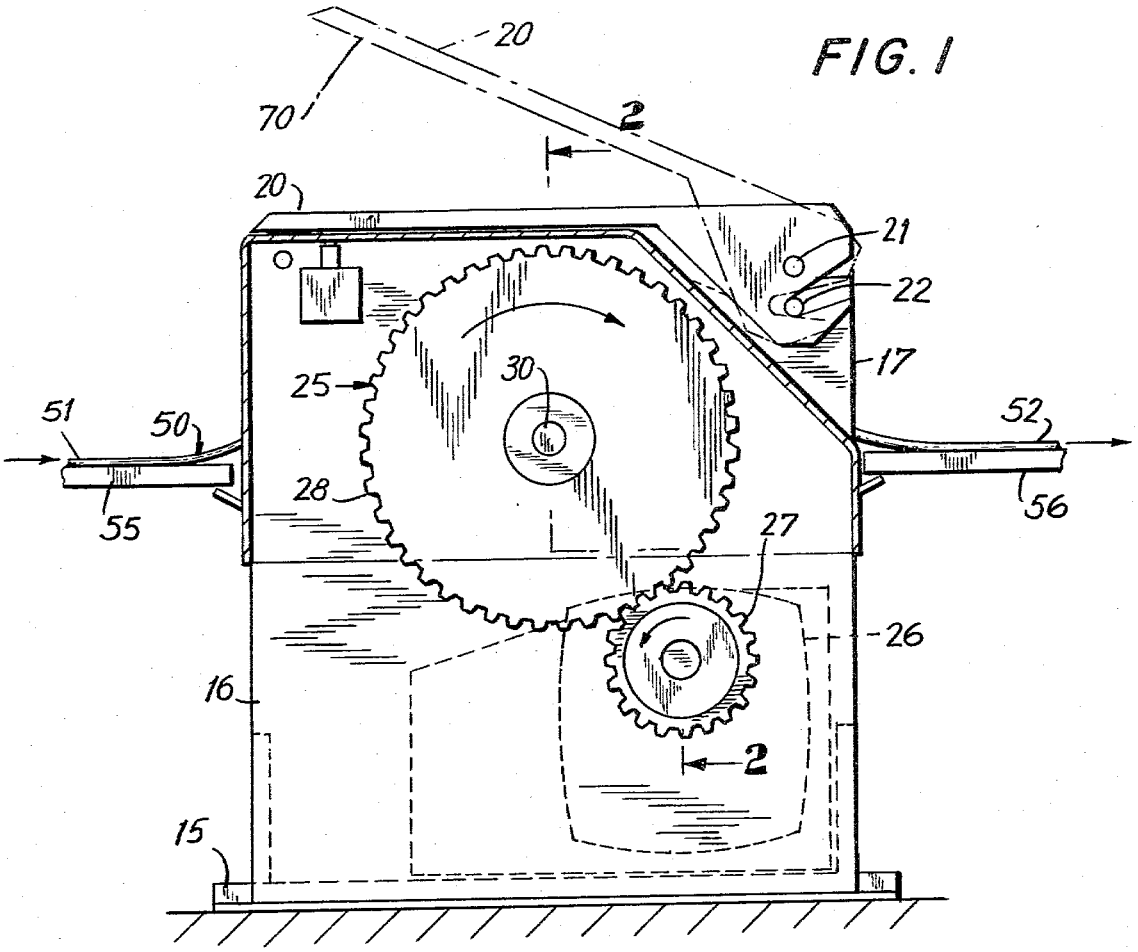
FIG. 1 is a side elevational view, with certain parts shown in section, of pumping apparatus in accordance with an illustrative embodiment of the invention.
Figure 6:
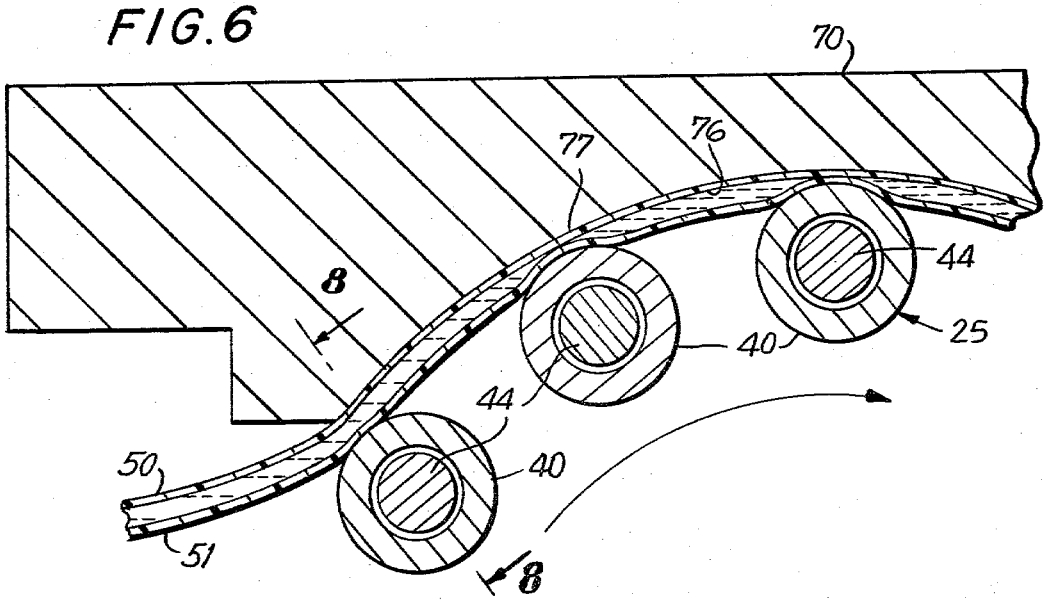
FIG. 6 is a fragmentary sectional view taken along the line 6—6 in FIG. 4.

Referring to FIG. 1 of the drawings, the pumping apparatus is supported on a base plate indicated generally at 15. A pair of side plates 16 and 17 extend upwardly from the base plate 15, and a cover plate 20 is disposed above the side plates across the top of the apparatus. The cover plate 20 is connected to the side plates 16 and 17 by a hinge pin 21 to permit the pivotal movement of the cover in an upward direction, as illustrated by the broken lines in FIG. 1, and thereby expose the internal components of the apparatus. The pivotal movement of the cover is limited by a stop pin 22.

Figure 2:
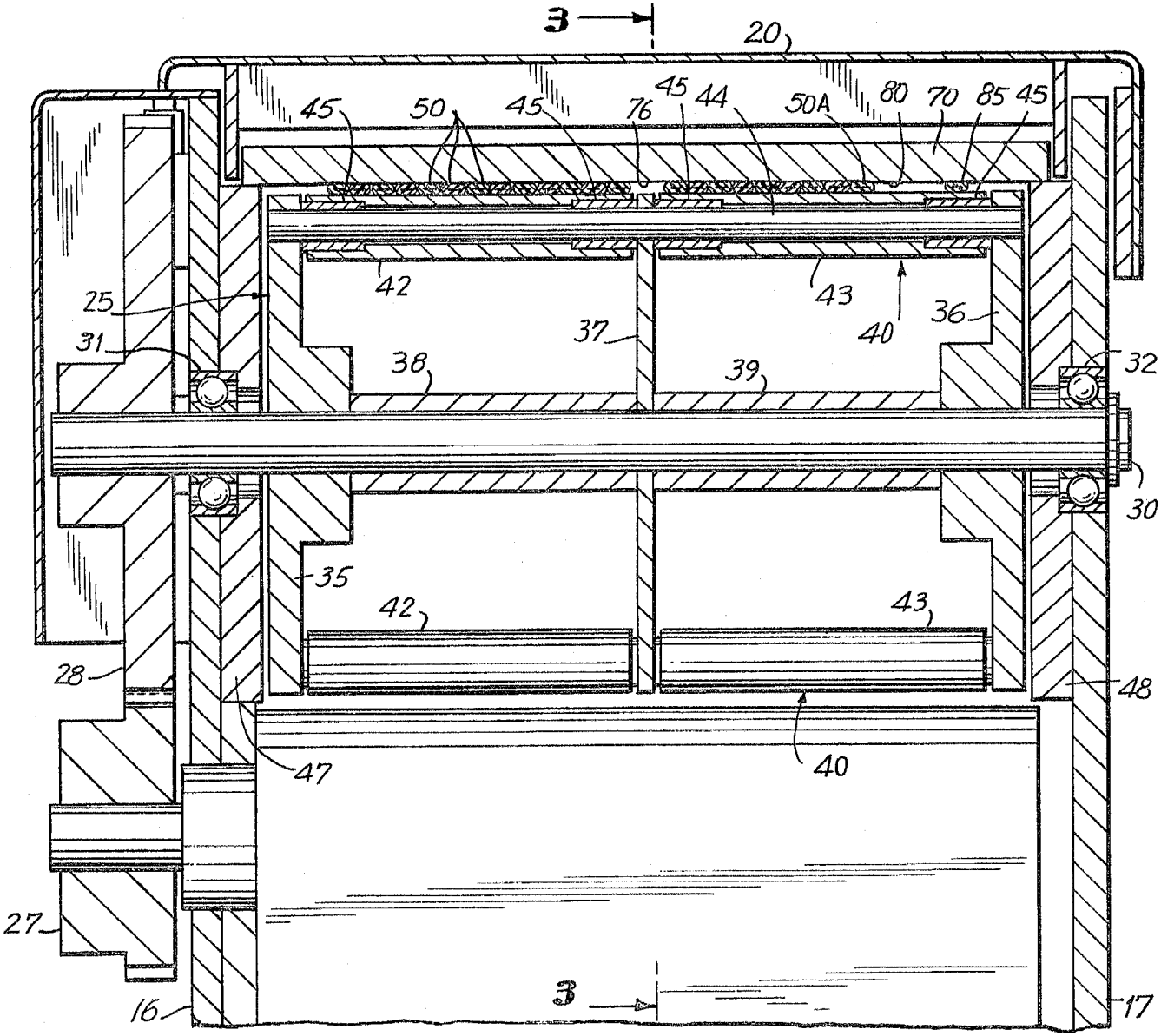
FIG. 2 is an enlarged vertical sectional view taken along the line 2—2 in FIG. 1.

A rotor assembly 25 is supported for rotation about a horizontal axis between the side plates 16 and 17. The rotor assembly 25 is driven by a constant speed motor 26 which is mounted on the side plate 16 and is connected to the assembly by spur gears 27 and 28. As best seen in FIG. 2, the assembly 25 is carried on a centrally located shaft 30 which extends through two bearing assemblies 31 and 32 in the respective side plates 16 and 17. The assembly 25 is of cylindrical configuration and includes circular end plates 35 and 36 rigidly affixed to the shaft 30 adjacent the side plates 16 and 17. An additional circular plate 37 is similarly affixed to the shaft 30 midway between the plates 35 and 36. The plate 37 is maintained in spaced relationship with the plate 35 by a sleeve 38, and a sleeve 39 similarly maintains the plate 37 in spaced relationship with the plate 36.

Rotatably supported between the plates 35 and 36 is a series of sleeve-shaped rollers 40. These rollers are equally spaced around the periphery of the rotor assembly 25, and the illustrated embodiment utilizes a total of ten rollers with a thirty-six degree spacing between adjacent rollers. Each of the rollers 40 comprises two axially aligned roller segments 42 and 43 which are located on opposite sides of the spacer plate 37 and are supported by a shaft 44. The shaft 44 extends through mating apertures adjacent the peripheries of the plates 35, 36 and 37 and is provided with suitable sleeve bearings 45 to permit the free rotation of the rollers with respect to the shaft.

The supporting structure for the rotor assembly 25 includes a pair of stationary side plates 47 and 48. The plates 47 and 48 are disposed adjacent opposite sides of the assembly 25 in face-to-face, abutting relationship with the side plates 16 and 17, respectively, and are spaced from the individual rollers 40 to avoid frictional engagement with the rollers at all times. The plates 47 and 48 serve to prevent the rotor assembly from appreciable sliding movement along its axis to thereby maintain the assembly in predetermined relationship with the adjacent structure.

An array of resiliently compressible tubes 50 is mounted immediately above the rotor assembly 25. Each of the tubes 50 is fabricated form polyvinyl chloride or other flexible material which may be readily compressed into a collapsed, fully occluded condition. The inlet ends 51 (FIG. 3) of some of the tubes 50 are continuously supplied with a sample of liquid to be analyzed, while the inlet ends of other tubes 50 are continuously supplied with a suitable reagent. In a manner that will become more fully apparent hereinafter, the apparatus is effective to pump the incoming fluids from the inlet ends 51 to the downstream or outlet ends 52. The reagent and sample are intermixed adjacent the downstream ends in the usual manner.

The inlet ends 51 of the tubes 50 are supported by a horizontal table 55. Similarly, the outlet ends 52 of the tubes are supported by a horizontal table 56. A bracket 58 of V-shaped cross-section extends between the side plates 16 and 17 and is suspended beneath an angularly disposed shelf 59. This shelf is provided with a clamp 60 which maintains the tubes in parallel substantially coplanar relationship with each other immediately adjacent the rotor assembly 25.

From the inlet clamp 60 each of the tubes 50 extends circumferentially around the upper periphery of the cylindrical rotor assembly 25. The tubes follow a circular path through approximately one hundred and fifteen degrees with respect to the axis of the shaft 30. On the downstream side of the rotor assembly 25 a bracket 63 extends between the side plates 16 and 17 and is suspended beneath an angularly disposed shaft 64 which supports an outlet clamp 65. The clamp 65 maintains the downstream portions of the tubes 50 in a stationary position immediately adjacent the rotor assembly.

Figure 3:
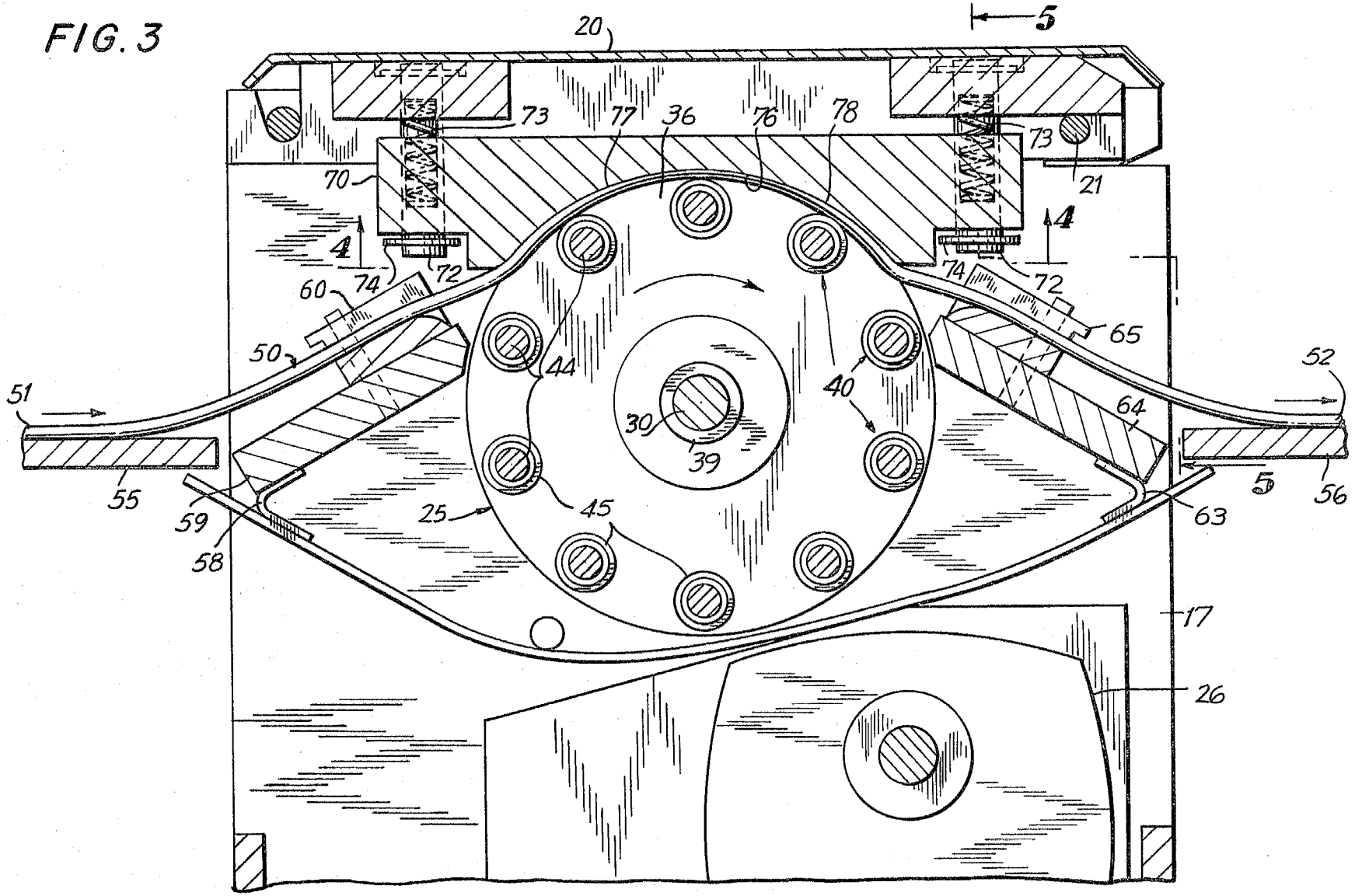
FIG. 3 is a vertical sectional view taken along the line 3—3 in FIG. 2.
Figure 4:
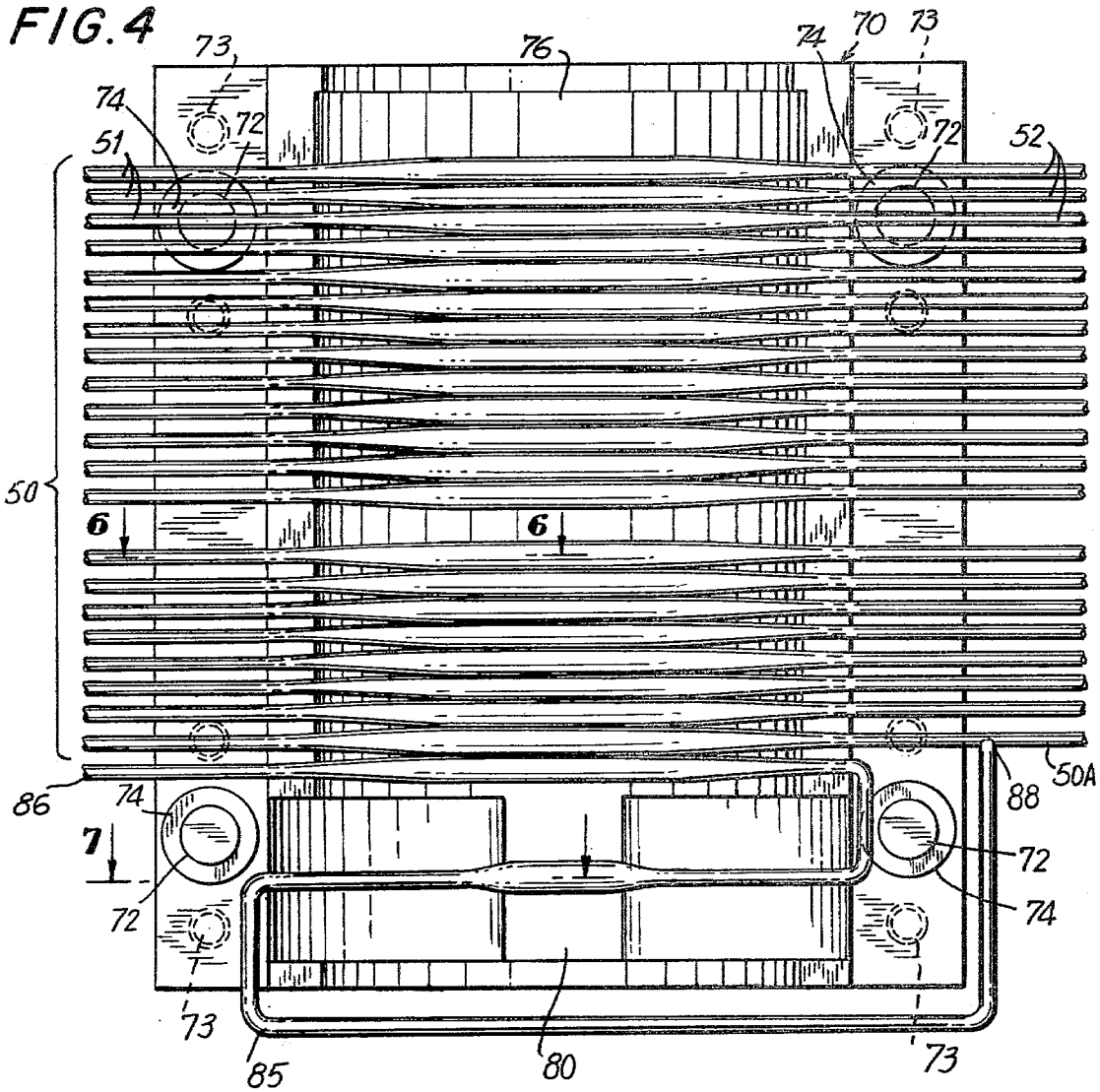
FIG. 4 is a horizontal sectional view taken along the line 4—4 in FIG. 3.
Figure 5:
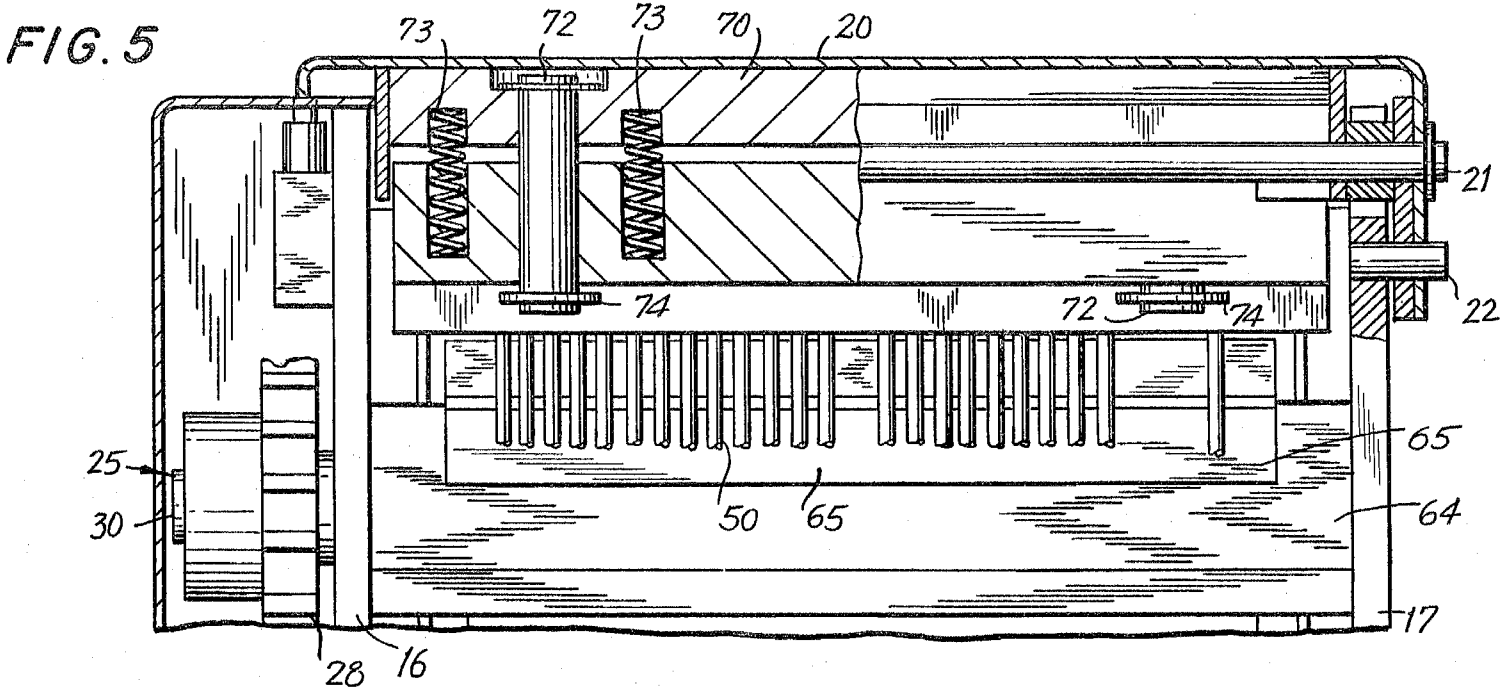
FIG. 5 is a vertical sectional view taken along the line 5—5 in FIG. 3.
Figure 9:
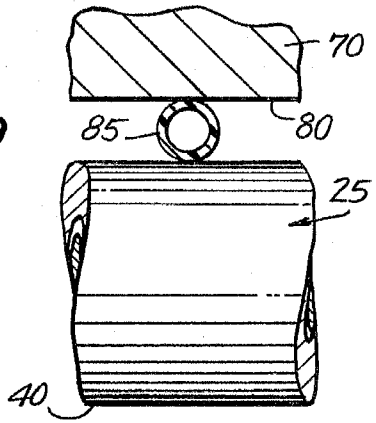
FIG. 9 is a fragmentary sectional view taken along the line 9—9 in FIG. 7.
Figure 8:
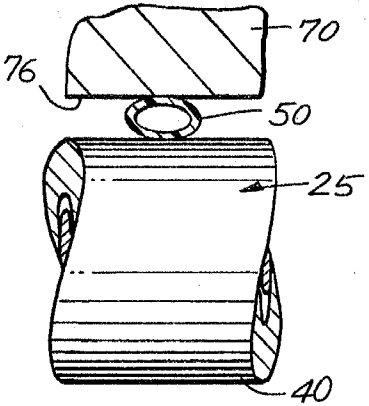
FIG. 8 is a fragmentary sectional view taken along the line 8—8 in FIG. 6.

A platen assembly 70 is resiliently mounted adjacent the side of the array of tubes 50 opposite that in contact with the rotor assembly 25. As best seen in FIGS. 3-5, the platen assembly 70 is movably connected to the cover 20 by a plurality of pins 72. A series of coil springs 73 serve to bias the platen assembly in a downward direction, as viewed in FIG. 3, against the tubes 50. The downward movement of the platen is limited by stop washers 74 adjacent the lower ends of the pins 72. The arrangement is such that the various tubes may be readily exposed for inspection or maintenance purposes by lifting the cover 20 to swing the cover and the attached platen assembly about the hinge pin 21 and thereby permit access to the individual tubes.

The side of the platen assembly 70 facing the array of tubes 50 includes a circumferential ledge portion 76 (FIGS. 3 and 4). The ledge portion 76 faces the periphery of the rotor assembly 25 and is provided with a partially cylindrical lower surface which defines the location of a pair of spaced points 77 and 78. The portion 76 extends between these points along a circular path around the periphery of the rotor assembly 25 through an angle of fifty-six degrees with respect to the axis of rotation, and it bears against each of the tubes 50 to resiliently urge the tubes against the rotor assembly. On the upstream and downstream sides of the points 77 and 78 the portion 76 is chamfered to minimize wear on the tubes.

The platen 70 also is provided with a second circumferential ledge portion 80. This latter ledge portion similarly is located on the side of the platen facing the rotor assembly 25 but is laterally spaced from the array of tubes 50. The arcuate lower surface of the ledge portion 80 is milled away to define a second pair of spaced points 82 and 83. The space between the points 82 and 83 is substantially less than that between the points 77 and 78 and illustratively is of the order of about twenty-four degrees with respect to the axis of rotation.

Extending between the platen 70 and the rotor assembly 25 is an additional resiliently compressible tube 85. The inlet end 86 of the tube 85 is continuously supplied with air or other segmentizing fluid different from the fluid in the tubes 50. The tube 85 is located in parallel coplanar relationship with the tubes 50 and is maintained in position by the clamps 60 and 65 (FIG. 3) such that it extends circumferentially around the upper periphery of the rotor.

As best seen in FIG. 4, the tube 85 proceeds from its inlet end 86 in the same direction as the tubes 50 between the rotor assembly 25 and the platen ledge portion 76. The tube then reversed direction and extends back between the ledge portion 80 and the rotor, and it then again reverses direction and proceeds downstream externally with respect to the rotor and the platen assembly. The downstream end of the tube 85 is maintained in continuous open communication with one of the tubes 50A in the array at a junction point 88.

In operation, the rotor assembly 25 is continuously rotated at a constant speed in a clockwise direction, as viewed in FIGS. 1 and 3, by the drive motor 26 and the gears 27 and 28. Because of the biasing springs 73 on the platen assembly 70, the platen is pressed downwardly to resilient urge the array of tubes 50 against the adjacent rollers 40. The additional tube 85 similarly is urged against the rollers 40 by each of the platen ledge portions 76 and 80.

As each of the rollers 40 moves beneath the tubes 50, it simultaneously compresses each tube to close or occlude the tube at the point 77 adjacent the upstream end of the platen ledge portion 76. The roller progressively occludes each tube over the entire distance between the point 77 and the point 78 to move the fluid within the tube ahead of the roller and to create suction behind the roller and thereby draw additional fluid through the tube. As the roller moved past the point 78, the tube begins to open, and the fluid behind the roller is urged toward the downstream end of the tube by the immediately succeeding roller.

Succeeding rollers 40 act on the tubes 50 in a similar manner to continuously advance predetermined quantities of fluid between adjacent rollers 40 from the infeed ends of the tubes to the discharge ends. The quantity of fluid between each pair of adjacent rollers is predetermined by the arcuate peripheral distance between the rollers and by the internal diameters of the tubes.

The air or other segmentizing fluid within the additional tube 85 is similarly pumped in a downstream direction as the individual rollers 40 progressively occlude the tube between the points 77 and 78. Such occlusion takes place over the entire distance between the points 77 and 78 with the result that the air is advanced through its tube at the same rate as that of the fluid within the tubes 50.

Figure 7:
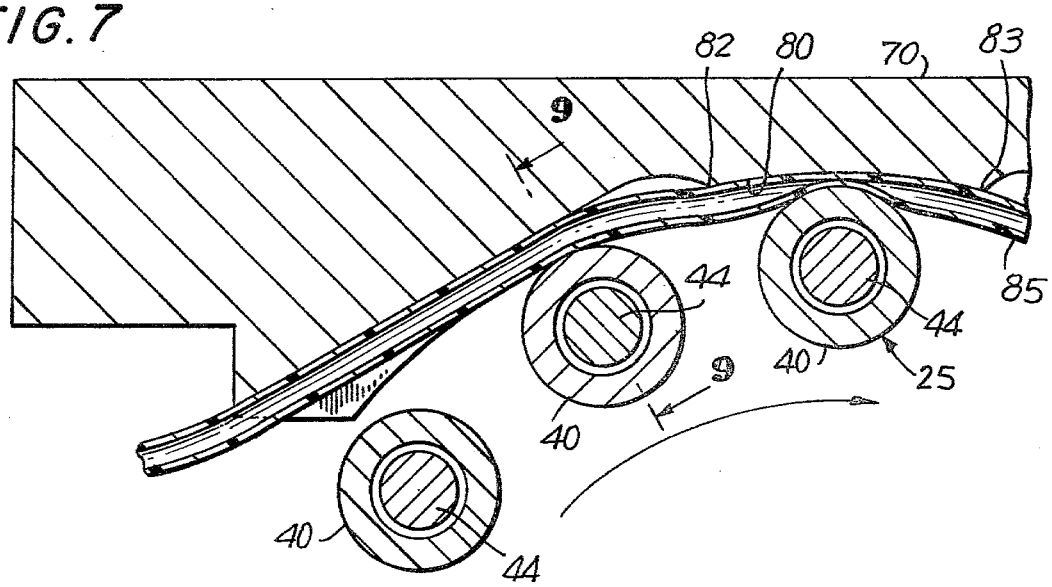
FIG. 7 is a fragmentary sectional view similar to FIG. 6 but taken along the line 7—7 in FIG. 4.

As indicated heretofore, after the segmentizing tube 85 passes between the rollers 40 and the ledge portion 76 on the platen assembly 70, it reverses direction and extends between the rollers 40 and the platen ledge portion 80. This latter ledge portion serves to progressively occlude or clamp the tube 85 over the entire distance between the points 82 and 83, a distance which is substantially shorter than the distance between the points 77 and 78. In the intervals between successive occlusions of the tube 85, the tube periodically admits predetermined quantities of the segmentizing fluid to the tube 50A at the junction point 88. Because of the reversal of direction of the tube 85, a suction effect takes place in the downstream portion of the tube, that is, the left hand portion as viewed in FIG. 7. This suction effect is transmitted to the junction point 88 (FIG. 4) with the tube 50A. The arrangement is such that upon the termination of the introduction of each successive quantity of segmentizing fluid into the tube 50A, a small portion of the fluid is sucked back into the tube 85 to provide a very clean and well defined break in the admitted fluid.

The segmentizing fluid from the tube 85 is admitted into the tube 50A in timed relation to the successive predetermined quantities of fluid in this latter tube. The timing is such that each successive introduction of segmentizing fluid takes place at the approximate midpoint of one of the predetermined quantities in the tube 50A. By introducing the segmentizing fluid during the time the fluid in the tube 50A is flowing past the junction point 88, rather than between successive quantities of fluid, an equidistant spacing between successive segments may be maintained without the need for making major adjustments to the apparatus for different tube diameters, flow rates, etc.

The spacing between the occlusion points 77 and 78 and between the individual rollers 40 is such that only two of the rollers are operative to fully occlude the tubes 50 at any one time. Because of the substantially shorter distance between the occlusion points 82 and 83, only a single roller occludes the portion of the tubes 85 between the ledge portion 80 and the rotor 25 at any one time. The contact between the rollers and the tubes is thus maintained at a minimum to reduce unnecessary tube wear.

Although the illustrated embodiment of the invention utilizes liquid fluids in the array of tubes 50 and air in the segmentizing tube 85, it will, of course, be apparent that various other fluids in either liquid or gaseous form may be employed depending upon the purpose for which the apparatus is being used. The segmentizing fluid should be inert with respect to the fluid in the tube 50A and advantageously should be of a type that does not contaminate or leave a residue on the interior of the tube.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. Pumping apparatus comprising, in combination:

an array of compressible tubes in parallel substantially coplanar relationship with each other;

rotor means located adjacent one side of the array of tubes in position to simultaneously occlude each of said tubes between a first part of spaced points along the length of the tube;

means supporting the rotor means for rotational movement relative to the array of tubes;

a platen assembly located adjacent the other side of the array of tubes in position to urge the same into contact with the rotor means, the platen assembly having a first ledge portion facing the periphery of the rotor means for defining the location of said first pair of spaced points and a second ledge portion facing the periphery of the rotor means for defining the location of a second pair of spaced points;

means for rotating the rotor means to progressively occlude the compressible tubes between said first pair of spaced points and thereby pump a first fluid through the tubes in a given direction; and an additional compressible tube containing a fluid different from said first fluid, the additional tube extending in said given direction between the rotor means and the first ledge portion of the platen assembly, then back in a direction opposite to said given direction between the rotor means and the second ledge portion of the platen assembly, and then to a junction point in open communication with one of the tubes in said array;

the rotation of said rotor means progressively occluding said additional compressible tube between said first pair of spaced points, to pump said different fluid therethrough in said given direction, and progressively occluding said additional compressible tube between said second pair of spaced points, to periodically admit said different fluid to said one tube in timed relation to the flow of the first fluid therein.

2. Pumping apparatus as defined in claim 1, in which the rotor means is of cylindrical configuration, and each of the ledge portions on said platen assembly includes a partially cylindrical surface in facing relationship with the rotor means.

3. Pumping apparatus comprising, in combination:

an array of compressible tubes in parallel substantially coplanar relationship with each other;

rotor means located adjacent one side of the array of tubes in position to simultaneously occlude each of said tubes between a first pair of spaced points along the length of the tube;

means supporting the rotor means for rotational movement relative to the array of tubes;

a resiliently mounted platen assembly located adjacent the other side of the array of tubes in position to urge the same into contact with the rotor means, the platen assembly having a first ledge portion facing the periphery of the rotor means for defining the location of said first pair of spaced points and a second ledge portion facing the periphery of the rotor means for defining the location of a second pair of spaced points, the spacing between said second pair of points being less than that between said first pair of points;

means for rotating the rotor means to progressively occlude the compressible tubes over the entire distance between said first pair of spaced points and thereby pump a first fluid through the tubes in a given direction; and an additional compressible tube containing a fluid different from said first fluid, the additional tube extending in said given direction between the rotor means and the first ledge portion of the platen assembly, then back in a direction opposite to said given direction between the rotor means and the second ledge portion of the platen assembly, and then to a junction point in open communication with one of the tubes in said array;

the rotation of said rotor means progressively occluding said additional compressible tube over the entire distance between said first pair of spaced points, to pump said different fluid therethrough in said given direction, and progressively occluding said additional compressible tube between said second pair of spaced points, to periodically admit said different fluid to said one tube in timed relation to the flow of the first fluid therein.

4. Pumping apparatus comprising, in combination:

an array of compressible tubes in parallel substantially coplanar relationship with each other;

rotor means located adjacent one side of the array of tubes in position to simultaneously occlude each of said tubes between a first pair of spaced points along the length of the tube;

means supporting the rotor means for rotational movement relative to the array of tubes;

a resiliently mounted platen assembly located adjacent the other side of the array of tubes in position to urge the same into contact with the rotor means, the platen assembly having a first circumferential ledge portion facing the periphery of the rotor means for defining the location of said first pair of spaced points and a second circumferential ledge portion facing the periphery of the rotor means for defining the location of a second pair of spaced points, the circumferential distance between said second pair of points being less than that between said first pair of points;

means for rotating the rotor means at a constant speed to progressively occlude the compressible tubes over the entire distance between said first pair of spaced points and thereby pump a first fluid through the tubes in a given direction; and an additional compressible tube containing a fluid different from said first fluid, the additional tube extending in said given direction between the rotor means and the first ledge portion of the platen assembly, then back in a direction opposite to said given direction between the rotor means and the second ledge portion of the platen assembly, and then externally with respect to the rotor means and the platen assembly with the downstream end of said additional tube in open communication with one of the tubes in said array at a junction point in the downstream portion of said one tube;

the rotation of said rotor means progressively occluding said additional compressible tube over the entire distance between said first pair of spaced points, to pump said different fluid therethrough in said given direction, and progressively occluding said additional compressible tube between said second pair of spaced points, to periodically admit said different fluid to said one tube in timed relation to the flow of the first fluid therein.

5. Pumping apparatus as defined in claim 4, in which the rotor means includes a cylindrical rotor assembly having a series of equally spaced rollers around its periphery for engaging said tubes at spaced points.

6. Pumping apparatus as defined in claim 5 in which not more than two of said rollers occlude the tubes in said array at any one time.

7. Pumping apparatus as defined in claim 5, in which only a single roller occludes said additional tube between said second pair of spaced points at any one time.

8. Pumping apparatus comprising, in combination:

an array of compressible tubes in parallel substantially coplanar relationship with each other;

rotor means located adjacent one side of the array of tubes in position to simultaneously occlude each of said tubes between a first pair of spaced points along the length of the tube;

means supporting the rotor means for rotational movement relative to the array of tubes;

a platen assembly located adjacent the other side of the array of tubes in position to urge the same into contact with the rotor means, the platen assembly having a first circumferential ledge portion facing the periphery of the rotor means for defining the location of said first pair of spaced points and a second circumferential ledge portion facing the periphery of the rotor means for defining the location of a second pair of spaced points;

means for rotating the rotor means at a constant speed to progressively occlude the compressible tubes over the entire distance between said first pair of spaced points and thereby pump a first fluid through the tubes in a given direction; and an additional compressible tube containing a fluid different from said first fluid, the additional tube extending in said given direction between the rotor means and the first ledge portion of the platen assembly, then back in a direction opposite to said given direction between the rotor means and the second ledge portion of the platen assembly, and then externally with respect to the rotor means and the platen assembly with the downstream and of said additional tube in open communication with one the tubes in said array at a junction point in the downstream portion of said one tube;

the rotation of said rotor means progressively occluding said additional compressible tube over the entire distance between said first pair of spaced points, to pump said different fluid therethrough in said given direction, and progressively occluding said additional compressible tube between said second pair of spaced points, to periodically admit said different fluid to said one tube in timed relation to the flow of the first fluid therein, the different fluid being admitted to said one tube during the flow of said first fluid past said junction point.

9. Pumping apparatus comprising, in combination:

an array of compressible tubes in parallel substantially coplanar relationship with each other;

rotor means located adjacent one side of the array of tubes in position to simultaneously occlude each of said tubes between a first pair of spaced points along the length of the tube, the rotor means including a cylindrical rotor assembly having a series of equally spaced rollers around its periphery for engaging said tubes at said spaced points;

means supporting the rotor means for rotational movement relative to the array of tubes;

a resiliently mounted platen assembly located adjacent the other side of the array of tubes in position to urge the same into contact with the rotor means, the platen assembly having a first circumferential ledge portion facing the periphery of the rotor means for defining the location of said first pair of spaced points and a second circumferential ledge portion facing the periphery of the rotor means for defining the location of a second pair of spaced points, the circumferential distance between said second pair of points being less than that between said first pair of points;

means for rotating the rotor means at a constant speed to progressively occlude the compressible tubes over the entire distance between said first pair of spaced points and thereby pump a first fluid through the tubes in a given direction; and an additional compressible tube containing a fluid different from said first fluid, the additional tube extending in said given direction between the rotor means and the first ledge portion of the platen assembly, then back in a direction opposite to said given direction between the rotor means and the second ledge portion of the platen assembly, and then externally with respect to the rotor means and the platen assembly with the downstream end of said additional tube in open communication with one of the tubes in said array at a junction point in the downstream portion of said one tube;

the rotation of said rotor means progressively occluding said additional compressible tube over the entire distance between said first pair of spaced points, to pump said different fluid therethrough in said given direction, and progressively occluding said additional compressible tube between said second pair of spaced points, to periodically admit said different fluid to said one tube in timed relation to the flow of the first fluid therein, the different fluid being admitted to said one tube during the flow of said first fluid past said junction point.

10. Pumping apparatus comprising, in combination:

an array of compressible tubes in parallel substantially coplanar relationship with each other;

rotor means located adjacent one side of the array of tubes in position to simultaneously occlude each of said tubes between a first pair of spaced points along the length of the tube, the rotor means including a cylindrical rotor assembly having a series of equally spaced rollers around its periphery for engaging said tubes at said spaced points;

means supporting the rotor means for rotational movement relative to the array of tubes, the supporting means including a pair of stationary side plates spaced from said rollers for maintaining the rotor assembly in predetermined relationship with the array of tubes;

a platen assembly located adjacent the other side of the array of tubes in position to urge the same into contact with the rotor means, the platen assembly having a first circumferential ledge portion facing the periphery of the rotor means for defining the location of said first pair of spaced points and a second circumferential portion facing the periphery of the rotor means for defining the location of a second pair of spaced points;

means for rotating the rotor means to progressively occlude the compressible tubes between said first pair of spaced points and thereby pump a first fluid through the tubes in a given direction; and an additional compressible tube containing a fluid different from said first fluid, the additional tube extending in said given direction between the rotor means the the first ledge portion of the platen assembly, then back in a direction opposite to said given direction between the rotor means and the second ledge portion of the platen assembly, and then to a junction point in open communication with one of the tubes in said array;

the rotation of said rotor means progressively occluding said additional compressible tube between said first pair of spaced points, to pump said different fluid therethrough in said given direction, and progressively occluding said additional compressible tube between said second pair of spaced points, to periodically admit said different fluid to said one tube in timed relation to the flow of the first fluid therein.

11. Pumping apparatus as defined in claim 10, in which each of said ledge portions has a cylindrical surface between the corresponding pair of spaced points, the cylindrical surface on said second ledge portion being laterally spaced from the cylindrical surface on said first ledge portion.

12. Pumping apparatus comprising, in combination:

an array of compressible tubes in parallel substantially coplanar relationship with each other;

rotor means located adjacent one side of the array of tubes in position to simultaneously occlude each of said tubes between a first pair of spaced points along the length of the tube, the rotor means including a cylindrical rotor assembly having a series of equally spaced rollers around its periphery for engaging said tubes at spaced points;

means supporting the rotor means for rotational movement relative to the array of tubes, the supporting means including a pair of stationary side plates spaced from said rollers for maintaining the rotor assembly in predetermined relationship with the array of tubes;

a resiliently mounted platen assembly located adjacent the other side of the array of tubes in position to urge the same into contact with the rotor means, the platen assembly having a first curcumferential ledge portion facing the periphery of the rotor means for defining the location of said first pair of spaced points and a second circumferential ledge portion facing the periphery of the rotor means for defining the location of a second pair of spaced points, the circumferential distance between said second pair of points being less than that between said first pair of points;

means for rotating the rotor means at a constant speed to progressively occlude the compressible tubes over the entire distance between said first pair of spaced points and thereby pump a first fluid through the tubes in a given direction; and an additional compressible tube containing a fluid different from said first fluid, the additional tube extending in said given direction between the rotor means and the first ledge portion of the platen assembly, then back in a direction opposite to said given direction between the rotor means and the second ledge portion of the platen assembly, and then externally with respect to the rotor means and the platen assembly with the downstream end of said additional tube in open communication with one of the tubes in said array at a junction point in the downstream portion of said one tube;

the rotation of said rotor means progressively occluding said additional compressible tube over the entire distance between said first pair of spaced points, to pump said different fluid therethrough in said given direction, and progressively occluding said additional compressible tube between said second pair of spaced points, to periodically admit said different fluid to said one tube in timed relation to the flow of the first fluid therein.

13. Pumping apparatus comprising, in combination:

an array of compressible tubes in parallel substantially coplanar relationship with each other;

rotor means located adjacent one side of the array of tubes in position to simultaneously occlude each of said tubes between a first pair of spaced points along the length of the tube, the rotor means including a cylindrical rotor assembly having a series of equally spaced rollers around its periphery for engaging said tubes at spaced points;

means supporting the rotor means for rotational movement relative to the array of tubes, the supporting means including a pair of stationary side plates spaced from said rollers for maintaining the rotor assembly in predetermined relationship with the array of tubes;

a resiliently mounted platen assembly located adjacent the other side of the array of tubes in position to urge the same into contact with the rotor means, the platen assembly having a first arcuate ledge portion facing the periphery of the rotor means for defining the location of said first pair of spaced points and a second arcuate ledge portion facing the periphery of the rotor means for defining the location of a second pair of spaced points, the arcuate distance between said second pair of points being less than that between said first pair of points;

means for rotating the rotor means at a constant speed to progressively occlude the compressible tubes over the entire distance between said first pair of spaced points and thereby pump a first fluid through the tubes in a given direction; and an additional compressible tube containing a fluid different from said first fluid, the additional tube extending in said given direction between the rotor means and the first ledge portion of the platen assembly, then back in a direction opposite to said given direction between the rotor means and the second ledge portion of the platen assembly, and then externally with respect to the rotor means and the platen assembly with the downstream end of said additional tube in open communication with one of the tubes in said array at a junction point in the downstream portion of said one tube;

the rotation of said rotor means progressively occluding said additional compressible tube over the entire distance between said first pair of spaced points, to pump said different fluid therethrough in said given direction, and progressively occluding said additional compressible tube between said second pair of spaced points, to periodically admit said different fluid to said one tube in timed relation to the flow of the first fluid therein, the different fluid being admitted to said one tube during the flow of said first fluid past said junction point.

* * * * *